United States Patent [19]

Robinson et al.

[11] 4,363,211

[45] Dec. 14, 1982

[54] QUASI-OPEN LOOP HYDRAULIC RAM INCREMENTAL ACTUATOR WITH POWER CONSERVING PROPERTIES

[75] Inventors: Curtiss W. Robinson; Eugene T. Raymond, both of Seattle, Wash.

[73] Assignee: The Boeing Company, Seattle, Wash.

[21] Appl. No.: 117,551

[22] Filed: Feb. 1, 1980

[51] Int. Cl.[3] ..... F15B 13/044

[52] U.S. Cl. ..... 60/476; 91/459; 417/271

[58] Field of Search ..... 60/473, 475, 476, 431, 60/DIG. 2; 417/271, 339, 338; 91/375 R, 459; 222/333

[56] References Cited

U.S. PATENT DOCUMENTS

| | | | |
|---|---|---|---|
| Re. 25,257 | 10/1962 | Ellis, Jr. . | |
| 844,090 | 2/1907 | Bijur . | |
| 1,229,009 | 6/1917 | Allison | 417/271 |
| 1,379,895 | 5/1921 | Aveline . | |
| 1,683,175 | 9/1928 | Falcke et al. . | |
| 1,851,902 | 3/1932 | Haeghen . | |
| 2,039,186 | 4/1936 | Pieper . | |
| 2,175,799 | 10/1939 | Hodgmann . | |
| 2,293,198 | 8/1942 | Filmer . | |
| 2,331,109 | 10/1943 | Ganahl . | |
| 2,478,068 | 8/1949 | Wallace . | |
| 2,871,830 | 2/1959 | Wirth et al. . | |
| 2,922,399 | 1/1960 | Panissidi et al. . | |
| 2,976,843 | 3/1961 | Weibel . | |
| 3,018,988 | 1/1962 | Ernst et al. . | |
| 3,027,878 | 4/1962 | Keyt et al. . | |
| 3,093,168 | 6/1963 | Colt et al. . | |
| 3,112,902 | 12/1963 | Kongelbeck . | |
| 3,185,439 | 5/1965 | Inaba et al. | 91/375 X |
| 3,301,269 | 1/1967 | Marwood . | |
| 3,417,667 | 12/1968 | Ikebe et al. | 91/375 |
| 3,489,889 | 1/1970 | Escobosa . | |
| 3,636,708 | 1/1972 | Karman et al. | 60/475 X |
| 3,736,488 | 5/1973 | Abraham et al. . | |
| 3,772,889 | 11/1973 | Mason et al. | 60/473 |
| 4,041,704 | 8/1977 | Gygli | 60/473 |
| 4,137,824 | 2/1979 | Boutell et al. . | |
| 4,297,086 | 10/1981 | McGowan | 417/271 |

*Primary Examiner*—Gerald A. Michalsky

*Attorney, Agent, or Firm*—Delbert J. Barnard; Eugene O. Heberer; Joan H. Pauly

[57] ABSTRACT

An electric stepping motor, operated by command signals from a computer or a microprocessor, rotates a rotary control member of a distributor valve, for sequencing hydraulic pressure and hence flow to the cylinders of an axial piston hydraulic machine. A group of the cylinders are subjected to pressure and flow and the remaining cylinders are vented to a return line. Rotation of the rotary control valve member sequences pressurization by progressively adding a cylinder to the forward edge to the pressurized group and removing a cylinder from the trailing edge of the pressurized group. The double ended pistons of each new pressurized group function to drive a wobble plate into a new position of equilibrium and then hold it in such position until another change in the makeup of the pressurized group. These pistons also displace hydraulic fluid from the opposite cylinder head which serves as the output of a pumping element. An increment of displacement of the wobble plate occurs in direct response to each command pulse that is received by the stepping motor. Wobble plate displacement drives the rotary valve of the hydraulic power transfer unit, causing it to transfer hydraulic fluid from a first expansible chamber on one side of a piston in a hydraulic ram to a second expansible chamber on the opposite side of the piston. Reverse drive of the hydraulic power transfer unit reverses the direction of transfer of hydraulic fluid between the two expansible chambers.

17 Claims, 6 Drawing Figures

QUASI-OPEN LOOP HYDRAULIC RAM INCREMENTAL ACTUATOR WITH POWER CONSERVING PROPERTIES

GOVERNMENT INTEREST

The government has rights to this invention pursuant to Contract No. F33615-77-C-2034 awarded by U.S. Airforce.

BACKGROUND OF THE INVENTION

1. Field of the Invention

This invention relates to hydraulic ram type actuators. More particularly, it relates to the provision of a hydraulic ram type actuator system which is capable of accepting a digital command and which exhibits certain advantages in efficient use of hydraulic power and an invulnerability to hardover failure of its output element when compared with a valved ram or a valved rotary hydraulic motor driven servo.

2. Description of the Prior Art

The actuator system of this invention is suitable for, but not limited to, use for positioning control surfaces of an aircraft, e.g. a flap.

Conventional systems for positioning control surfaces of an aircraft normally utilize a valved ram or valved rotary hydraulic motor type actuator. A disadvantage of these systems is that the valved hydraulic ram or motor cannot adapt its power consumption to load demands and must dissipate large amounts of hydraulic power across the orifices of its control valve whenever a high rate with less than maximum output force or torque is demanded. A second disadvantage of such systems is that they require a feedback to insure adequate dynamic response and as a result are susceptible to a hardover reaction of the output in the event of a loss of the feedback signal continuity.

There are some flight control surface actuators in existence which have power conserving properties when used on dynamically active surfaces. However, under static output conditions, these systems waste power by keeping a variable displacement pump in constant rotation at a high rotational speed.

Present trends of aircraft actuation systems are toward electrically controlled hydraulic actuators. Centrally located on-board digital computers or dispersed individual microprocessors are foreseen to provide the command signals to these actuators. Present state-of-the-art actuators and controls are analog type devices that require digital to analog conversion components to be compatible with the digital electric control signals.

SUMMARY OF THE INVENTION

According to an aspect of the present invention, an electric stepping motor, operable by an incremental command signal, is used to operate a rotary distributor valve which serves to control the flow of hydraulic fluid to and from a hydraulic power transfer unit. The power transfer unit comprises a plurality of piston-cylinder units and means operable in response to sequenced pressurization of cylinders, and attendant piston movement, to drive a wobble plate which sequences an output valve. These pistons, being double ended, serve also to displace fluid to or from the output ports of the power transfer unit. The output shaft of the stepping motor is connected to a rotary port control member which, when rotated, opens and closes ports to control the distribution of hydraulic fluid to and from the output cylinders. During operation, a group of the cylinders which are pressurized in series are in communication with hydraulic pressure and the rest are vented to a return line. Stepping motor rotation of the rotary control member sequences pressurization by progressively adding a cylinder to the forward edge of the pressurized group and removing a cylinder from the trailing edge of the pressurized group, to in that manner deliver driving pulses of hydraulic pressure to the pistons of the hydraulic power transfer unit. Each group of pressurized cylinders functions to drive the wobble plate output of the hydraulic transfer unit into a new position of equilibrium and then hold it in such position until another change is made in the makeup of the pressurized group. Owing to this arrangement, an increment of wobble displacement of the wobble plate output member occurs in direct response to each command pulse that is received by the stepping motor.

An increment of wobble plate motion in one direction results in an increment of fluid transfer from one side of the piston in a hydraulic ram to the other side and an increment of wobble plate motion in the opposite direction results in a reversal in the direction of fluid transfer and ram movement.

Accordingly a principal object of the present invention is to provide an electrohydraulic mechanism which will provide an incremental displacement or movement of a hydraulic ram for each electric pulse transmitted from a computer or microprocessor.

An advantage of this type of system is that the hydraulic power transfer unit demands hydraulic flow and demands power only in proportion to the magnitude of the output load or force of the ram.

Another object of the present invention is to provide an incrementally driven linear hydraulic motor or ram with a source of make-up hydraulic fluid or quiescent pressure for substantially maintaining a predetermined average pressure level between the two sides of the piston, in order to maintain output stiffness of the ram. One system for performing this function includes a regulating valve which meters flow of make-up fluid in response to fluctuations in the average of the two pressures on the opposite sides of the ram piston. A hydraulic ram incremental actuator equipped with a make-up system of this type, may be provided with a monitor feedback circuit which senses the position of the driven member and sends a signal based on such position to apparatus for changing the command signal to the stepping motor, if necessary, in order to bring the input and output functions into synchronization.

In another embodiment of the invention, the apparatus used for providing quiescent pressure for the ram includes a four-way flow control valve of low capacity or gain adapted to drive the ram in parallel with the output of the positive displacement hydraulic transfer unit. This form provides an absolute correspondence between the electric stepper motor input and the ram output. No monitor feedback is required in this case because all fine position is accomplished by the control valve and its positioning mechanism.

According to an aspect of the invention, the linear hydraulic motor or ram actuator is used aboard an aircraft for actuating a flight control flap or the like and command signals for the stepping motor are provided by an onboard digital computor or microprocessor.

These and other objects, advantages and features of the present invention are evident from the embodiments of the invention which are illustrated by the drawings and described in detail below.

BRIEF DESCRIPTION OF THE DRAWINGS

In the drawings like element designations refer to like parts, and.

DESCRIPTION OF PREFERRED EMBODIMENTS

Figure 1:
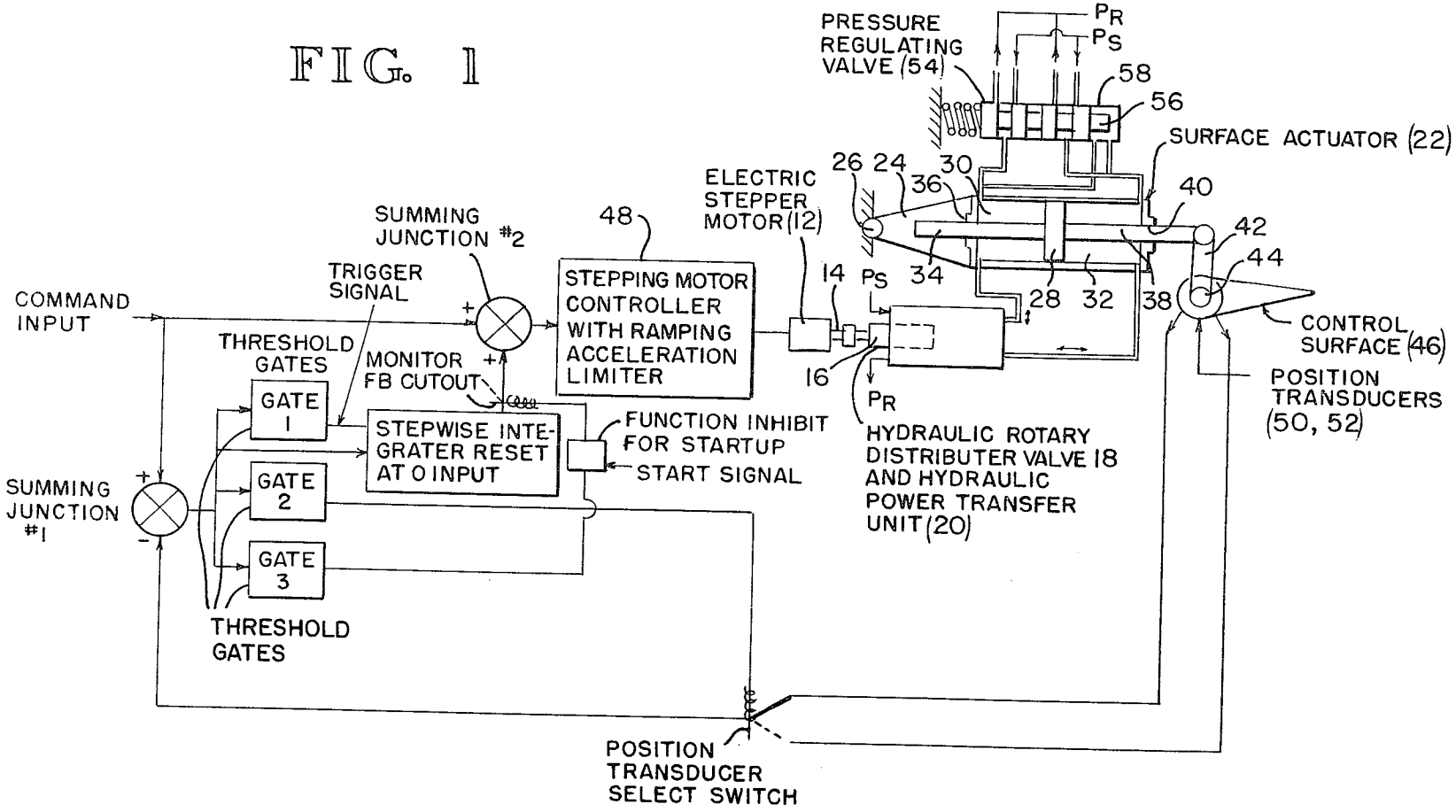
FIG. 1 is a schematic diagram of a first embodiment of the invention, in which the linear hydraulic motor or ram is used aboard an aircraft for moving a control surface, and is provided with a feedback monitor for the stepping motor controller and a make-up valve controlled by an average of the two pressures on the opposite sides of the ram piston.

Referring first to FIG. 1, an electrical stepping motor 12 is shown to include an output shaft 14 which is coupled to a rotary port control member 16 of a rotary hydraulic pressure distributor valve 18.

Valve 18, which will be hereinafter described in detail, may be housed within an end portion of hydraulic power transfer unit 20. Such unit, which will also be hereinafter described in detail, comprises a piston type hydraulic motoring section, controlled by the valve 18, which drives a positive displacement apparatus for transferring hydraulic fluid between the two sides of a piston in a linear hydraulic motor or ram 22.

Ram 22 is shown to comprise a cylinder 24, an end 26 of which is suitably connected to a support member. A balanced piston 28 within cylinder 24 divides the interior of the cylinder into first and second expansible chambers 30, 32, located at opposite sides of the piston 28. A first piston rod 34 extends from one side of piston 28, through chamber 30, and then through a sealed opening 36 formed in the end wall at the fixed end of the cylinder 24. Piston rod 34 terminates in a free end outside of the cylinder 24. A second piston rod 38 extends in the opposite direction from the piston 28, through chamber 32, and then out through a sealed opening 40 in the opposite end wall of cylinder 24. The outer end of piston rod 38 is attached to a load, e.g., an end of a crank arm 42 which extends radially outwardly from a live shaft 44 on a control surface 46.

The electric stepper motor 12 is reversible and is controlled by a command signal from a controller 48. In the embodiment shown by FIG. 1, the control surface shaft 44 is connected to and drives a pair of shaft encoders or position transducers 50, 52, which are a part of a monitor feedback system.

In operation of the monitor feedback circuit, an error is generated at summing junction #1 between the input command and a signal from a position transducer 50, 52, indicating the position of the control surface 46. This error is compared to several fixed magnitude values. When the first gate value is exceeded a train of corrective pulses or steps, whose sum is equal to the magnitude of the first gate error threshold, is added to the system command at summing junction #2. This train of corrective pulses is input at a limited rate and serves to bring input and output functions into synchronization at the time of system start up and correct errors or missed steps which occur for any reason. Comparison of error with a second and larger gate threshold at gate 2 is used to switch the monitor feedback function from a primary output encoder 50 to a secondary or standby unit 52. A third and still higher error threshold level at gate 3 is used to disable the error correcting function altogether, causing the unit to revert to operation as an open-loop stepping motor feedback correction.

Know feedback systems are "high gain" closed-loop systems. In the event of a failure of the feedback continuity the flight control surface or other driven element that is being actuated by the conventional actuator would slam hard over to a stop position. If the monitor system of the present invention were to fail, the driven element would not slam hard over. It would move over but slowly, causing the monitor system to disconnect the error corrective feedback function. The pilot would have sufficient time to detect if something was wrong and correct it by manually trimming out whatever positional error was present at the control surface.

Figure 2:
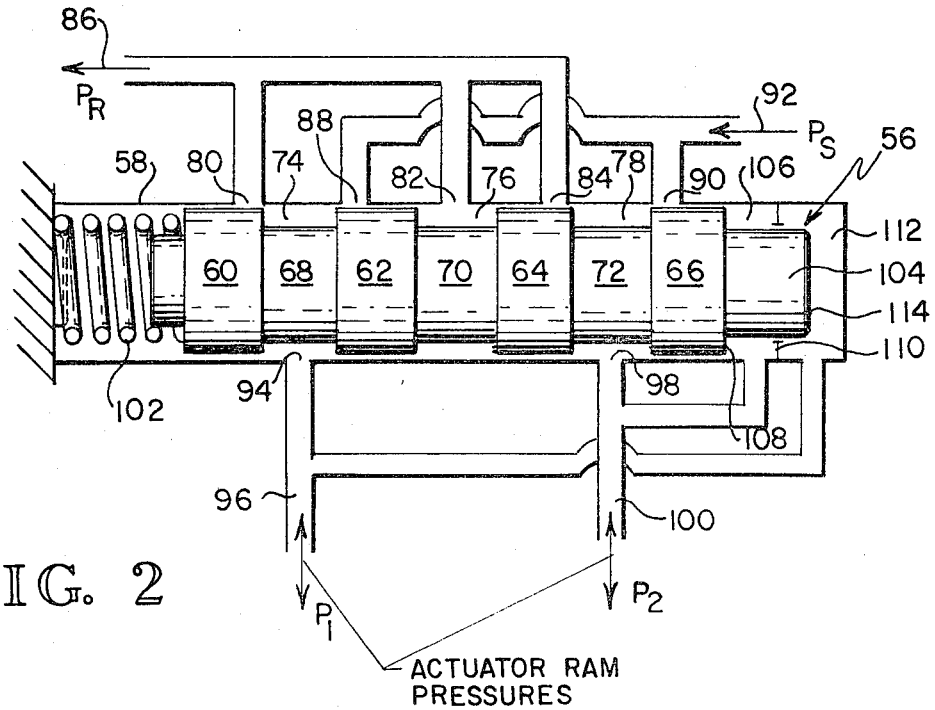
FIG. 2 is an enlarged scale view of the make-up valve shown in FIG. 1.

In a manner to be hereinafter described in detail, operation of the hydraulic power transfer unit 20 results in an incremental transfer of hydraulic fluid from one of the ram chambers 30, 32 to the other. In a system of this type it is necessary to provide a source of makeup hydraulic fluid to maintain a predetermined desired average pressure level between the two sides of the control ram or actuator 22 in order to maintain sufficient output stiffness of the ram 22. The make-up circuit shown by FIG. 1 includes a pressure regulating valve 54 which includes a port control member 56 located within a housing 58. As best shown by FIG. 2, port control member 56 may be in the form of a spool comprising a plurality of axially spaced apart lands 60, 62, 64, 66 separated by reduced diameter portions 68, 70, 72. Annular chambers 74, 76, 78 are formed within the housing 58 axially between each adjacent pair of lands and circumferentially about the reduced diameter portions of the spool 56. In conventional fashion, the housing 58 is constructed to include a plurality of ports 80, 82, 84, constituting inlets to passageways which communicate with the return pressure line 86 of a hydraulic fluid circuit. Housing 58 also includes ports 88, 90, constituting outlets for passageways leading from the system pressure line 92. Housing 58 further includes a port 94 at the valve end of a passageway 96 which communicates with expansible chamber 30 and a port 98 at the valve end of a passageway 100 which communicates with expansible chamber 32.

A first end of port control member 56 is in contact with a compression spring 102 which functions to bias spool 56 to the right, as pictured. The opposite end of spool 56 includes a reduced diameter portion 104 extending endwise outwardly from land 56. An annular chamber 106 is formed around end portion 104, between an end surface 108 of land 66 and an opposing radial surface of a fixed wall 110. End portion 104 is snuggly received in a central opening in wall 110. A seal is provided between the two so that when leakage does not occur between chamber 106 and another fluid chamber 112 located on the opposite side of wall 110.

One of the passageways 96, 100 communicates with chamber 106 and the other communicates with chamber 112. As a result, the pressure within one of the chambers 30, 32 is subjected to the end surface 108 on land 66 and the pressure in the other chamber 30, 32 is subjected to an end surface 114 at the end of spool 56 opposite the spring 102. This arrangement will result in an average of the pressures in the two chambers 30, 32 acting to produce a force on member 56 in opposition to the force of the spring 102 action on the opposite end of member 56. As long as the average pressure does not vary from a predetermined desired value, the system is in equalibrium and there is no movement of valve member 56. However, any change in the average pressure of the two chambers 30, 32 will be sensed at the pressurized end of member 56, and will result in endwise movement of member 56. As is evident from FIGS. 1 and 2, a decrease in the pressure created force at the pressurized end of member 56 would result in a movement of member 56 to the right (as illustrated). Movement of lands 62, 60 out from positions in which they block ports 88, 90, results in system pressure being communicated to both chambers 30, 32, via supply avenues 92, 88, 74, 94, 96 and 92, 90, 78, 98, 100. When the pressure in chamers 30, 32 is increased to the desired level the pressure created force at the pressurized end of member 56 will increase enough to move member 56 back to the left (as pictured) in opposition to the force of spring 102, until lands 62, 64 again close the ports 88, 90. Any excess pressure force will move member 56 an additional amount to the left (as pictured) until lands 60, 64 are moved out from positions in which then block the ports 80, 84. This results in a momentary venting of the chambers 30, 32 to the pressure return 96, via avenues 96, 94, 74, 80 and 100, 98, 78, 84. Such venting will continue until the over pressure condition is relieved, the pressure created force at the pressurized end of member 56 is reduced, and the spring 102 has returned the member 56 to the position shown by FIG. 2.

A second method of providing quiescent pressure for a ram actuator constructed according to the present invention employs a four-way flow control valve 116 of low capacity or gain to drive the ram 118 in parallel with outputs of the power transfer unit 20. This type of valve action provides an absolute correspondance between the electric stepper motor input and the hydraulic ram output. No monitor feedback is required in this type of system because all fine positioning is accomplished by the four-way valve 116 and the hydraulic servo repeater circuit. The power transfer unit 20 handles the major portion of any command response. The parallel valve system acts as an integrating trim and also provides for regulation of the quiescent ram pressures.

Figure 3:
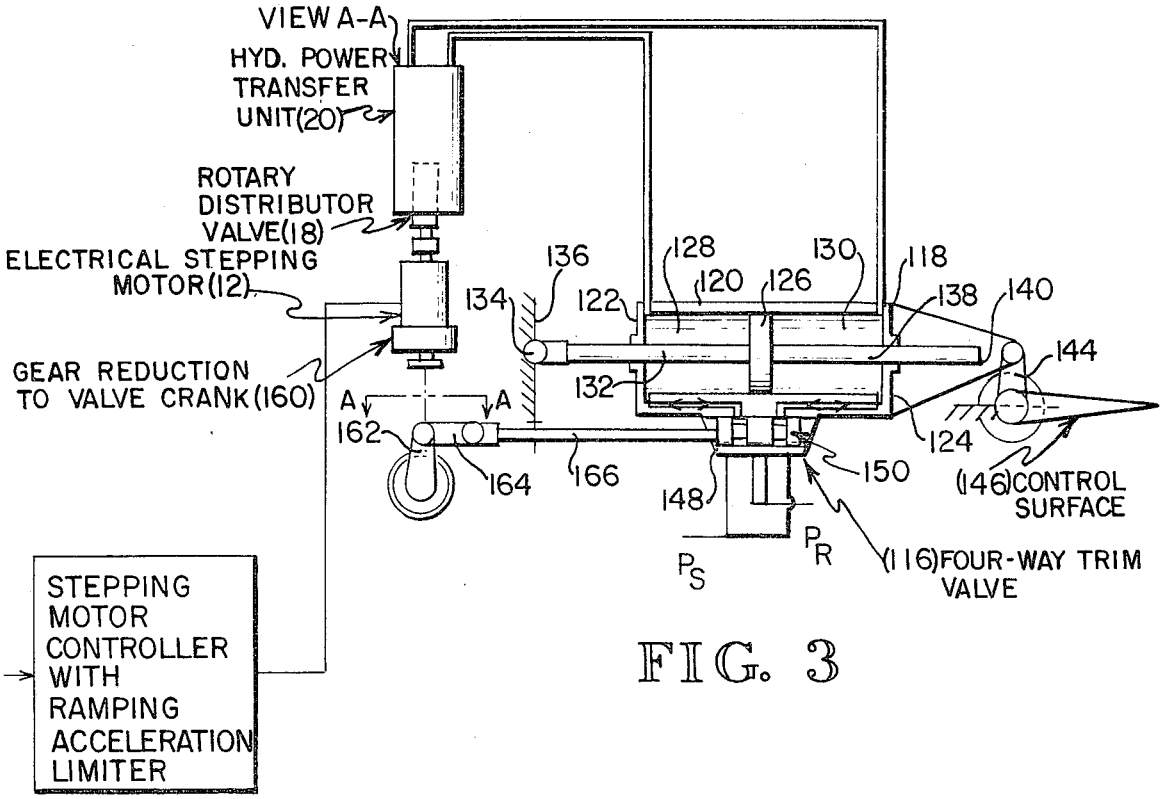
FIG. 3 is a schematic view of a second embodiment of the invention, in which a four-way flow control valve of low capacity or gain is used to drive the ram in parallel with outputs of the power transfer unit.

Referring to FIG. 3, the second embodiment of the invention comprises a cylinder 120 having end walls 122, 124. A piston 126 divides the interior of the cylinder 120 into first and second expansible chambers 128, 130. A first piston rod 132 projects from piston 126, through chamber 128, and then through a sealed opening in end wall 122. Piston rod 132 includes a suitable connector 134 at its outer end for connecting it to a fixed support 136. A second piston rod 138 projects from piston 126 in the opposite direction, through chamber 130, and then through a sealed opening in end wall 124, and terminates in a free end 140. Piston rod 138 is provided to balance the areas of the pressure faces of the piston 126.

In this embodiment the piston assembly 126, 132, 140 is fixed and the cylinder 120 moves relative to it as hydraulic fluid is exchanged between the two chambers 128, 130. The end of cylinder 120 opposite the piston connection 134 is connected to a load, shown in the form of a crank are 144 which projects radially from a live shaft of a control surface 146. As is evident, axial movement of cylinder 120 will cause the control surface 140 to pivot about the axis of such shaft.

In this embodiment the housing 148 of trim valve 116 is carried by and may be an integral a part of the housing of cylinder 120. Housing 148 includes an elongated chamber for receiving a sliding port control member 150 which may be of the spool type. In a manner conventional to four-way spool type valves, the housing 148 is formed to include a pair of ports 152, 154 connectable with the system return line 155 and a pair of ports 156, 158 connectable with the system pressure line 159.

The electric stepping motor 12 includes an output shaft at its end opposite the rotary distributor valve 18 which is connected to and drives a gear reduction 160 having a rotary output connected to a crank arm 162. Thus, the stepping motor 12 rotates both the distributor valve port control member and the crank arm 162, about coinciding axes. The outer end of crank arm 162 is connected via a short link 164 having a pivot joint at each of its ends to a guided connector rod 166 which in turn is connected to the valve spool member 150.

Figure 4:
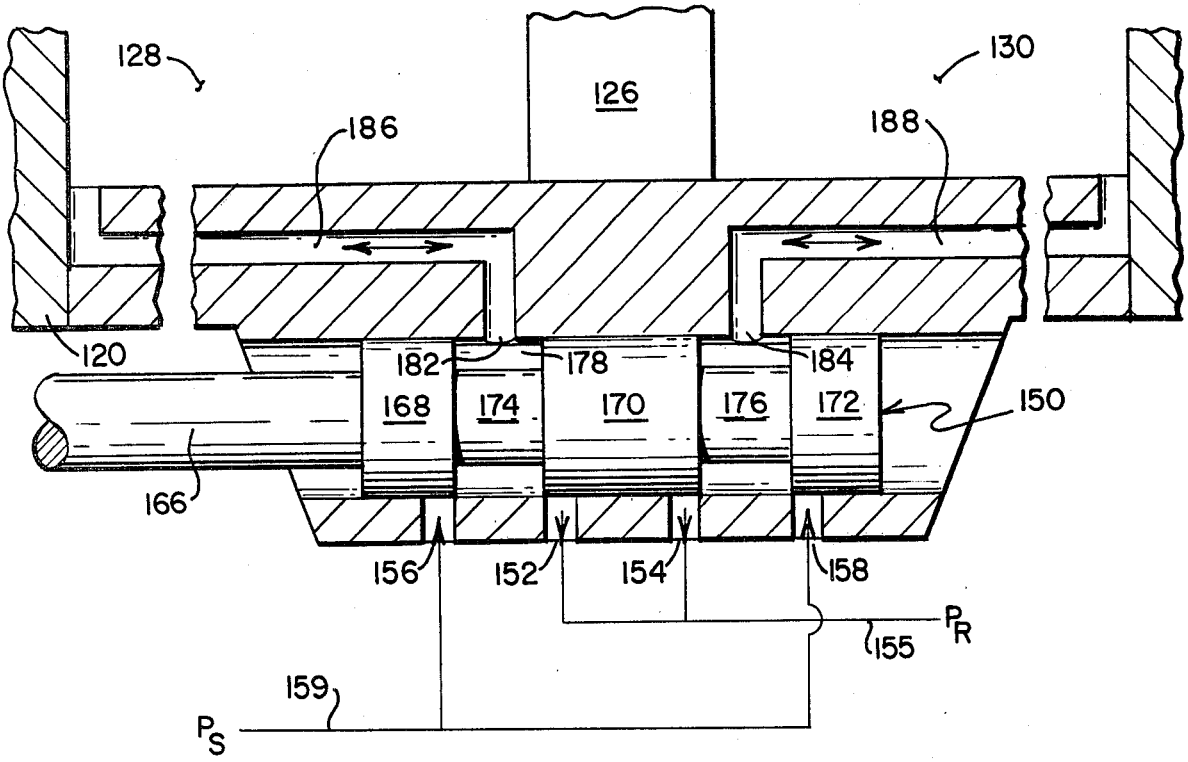
FIG. 4 is an enlarged scale view of the four-way flow control valve shown in FIG. 3.

As best shown by FIG. 4, valve spool member 150 comprises lands 168, 170, 172, and reduced diameter portions 174, 176, between adjacent lands. Annular fluid chambers 178, 180 are defined axially between the lands 168, 170, 172 and about the reduced diameter portions 174, 176. The cylinder housing is formed to include ports 182, 184, communicating with the chambers 178, 184, respectively. Port 182 also communicates with a passageway 186 leading into chamber 128 and port 184 communicates with a passageway 188 leading into chamber 130.

As previously explained, operation of hydraulic power unit 20 in one direction transfers hydraulic fluid from chamber 128 to chamber 130 and operation in the opposite direction reverses the direction of fluid transfer. Hydraulic power transfer unit 20 is driven in increments and hence it transfers fluid in increments and the ram 118 is driven in increments. The gear ratio of gear reducer 160 is chosen such that ideally the valve port control member 150 will move axially in increments which are equal to the increments of movement of cylinder housing 120 for any given incremental rotation of the stepping motor 12. In other words, the system design is that the trim valve housing 148, which is a part of or is carried by the housing of cylinder 120, and the valve port control member 150 will move together in equal increments or bits. When this happens the trim valve 116 will not function as neither trim nor fluid make-up are necessary. However, if the electric stepper motor input and the hydraulic ram output get out of synchronization for any reason, a differential movement of housing 148 and port control member 150 will occur, causing valve 116 to function by supplying fluid for driving the ram 118 in a position-correcting direction.

For example, a differential movement of the port control member 150 to the right, as illustrated in FIG. 4, will result in movement of lands 170, 172 to uncover ports 152, 158. This results in chamber 130 being brought into communication with the system pressure via port 150, chamber 180, port 184 and passageway 188. It also results in chamber 120 being brought into communication with the system return pressure via passageway 186, port 182, chamber 178 and port 152. Since the piston 128 is fixed and the cylinder 120 is allowed to move, this addition of fluid into chamber 130 and removal of a like amount of fluid from chamber 120, will cause the cylinder 120, and hence the ram output, and the valve housing 148, to be shifted to the right (as pictured).

Although the system of FIG. 3 is illustrated to employ a mechanical connection between an output of the electric stepping motor 12 and the port controller four-way valve 116, it is to be understood that the same result could be obtained by using a digital-to-analog converter driving an analog electrohydraulic valve with either digital or analog feedback of the ram output position.

Figure 5:
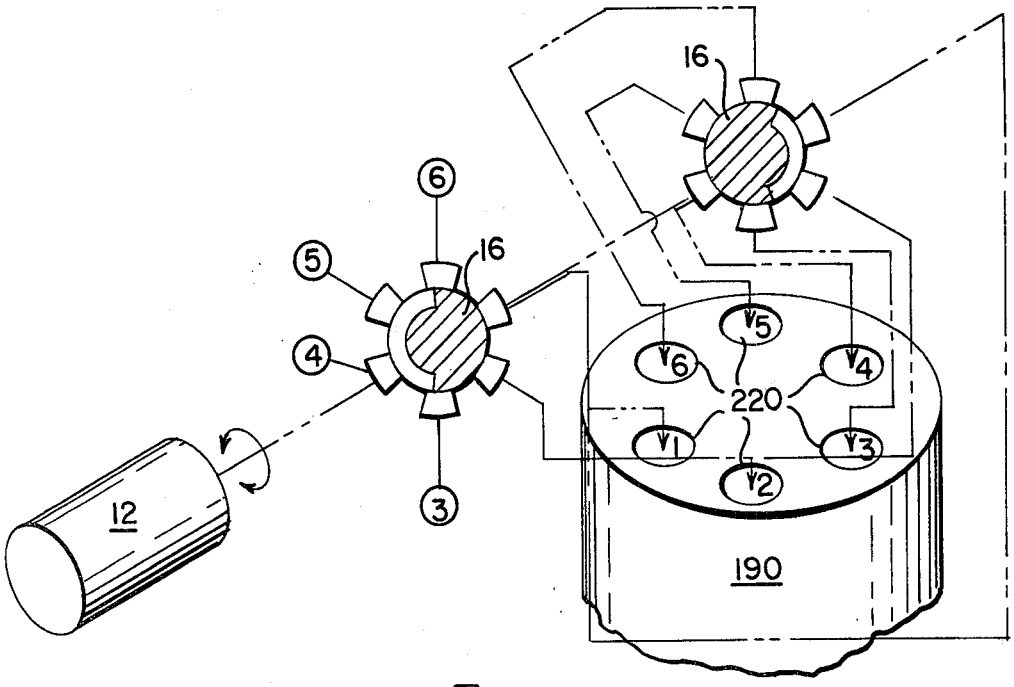
FIG. 5 is an isometric diagrammatical view of the stepping motor, the distributor valve and an end portion of the hydraulic motoring section for the fluid power transfer unit.

FIG. 5 is a diagram of a porting sequence for a six cylinder hydraulic motoring device of a type which may be used in the power transfer unit 20. In this figure the valve ports in both the pressure and return sections of the valve have been given the same numbers as the associated cylinders of the hydraulic motor. The sequence of pressurization can be determined from FIG. 5 by visualizing a step-by-step rotation of the valve port control member 16. Such sequence of pressurization may be diagrammed as follows:

Six Cylinder Sequence of Pressurization

| | | | | | | | |
|---|---|---|---|---|---|---|---|
| 1 | 2 | | | | | | |
| 1 | 2 | 3 | | | | | |
| | 2 | 3 | | | | | |
| | | 2 | 3 | 4 | | | |
| | | | 3 | 4 | | | |
| | | | 3 | 4 | 5 | | |
| | | | | 4 | 5 | | |
| | | | | 4 | 5 | 6 | |
| | | | | | 5 | 6 | |
| | | | | | 5 | 6 | 1 |
| | | | | | | 6 | 1 |
| | | | | | | 6 | 1 2 |

Diagram I

The number of cylinders is a variable. By way of example, another installation may involve a nine cylinder motor and a sequence of pressurization as follows:

Nine Cylinder Sequence of Pressurization

| | | | | |
|---|---|---|---|---|
| 1 | 2 | 3 | | |
| 1 | 2 | 3 | 4 | |
| | 2 | 3 | 4 | |
| | 2 | 3 | 4 | 5 |
| | | 3 | 4 | 5 |
| | | | etc. | |

Diagram II

The sequence of pressurization that is illustrated by these diagrams is of a type which progresses first by adding a cylinder to the forward edge of the pressurized group of cylinders and then removing from the trailing edge of the pressurized group.

Figure 6:
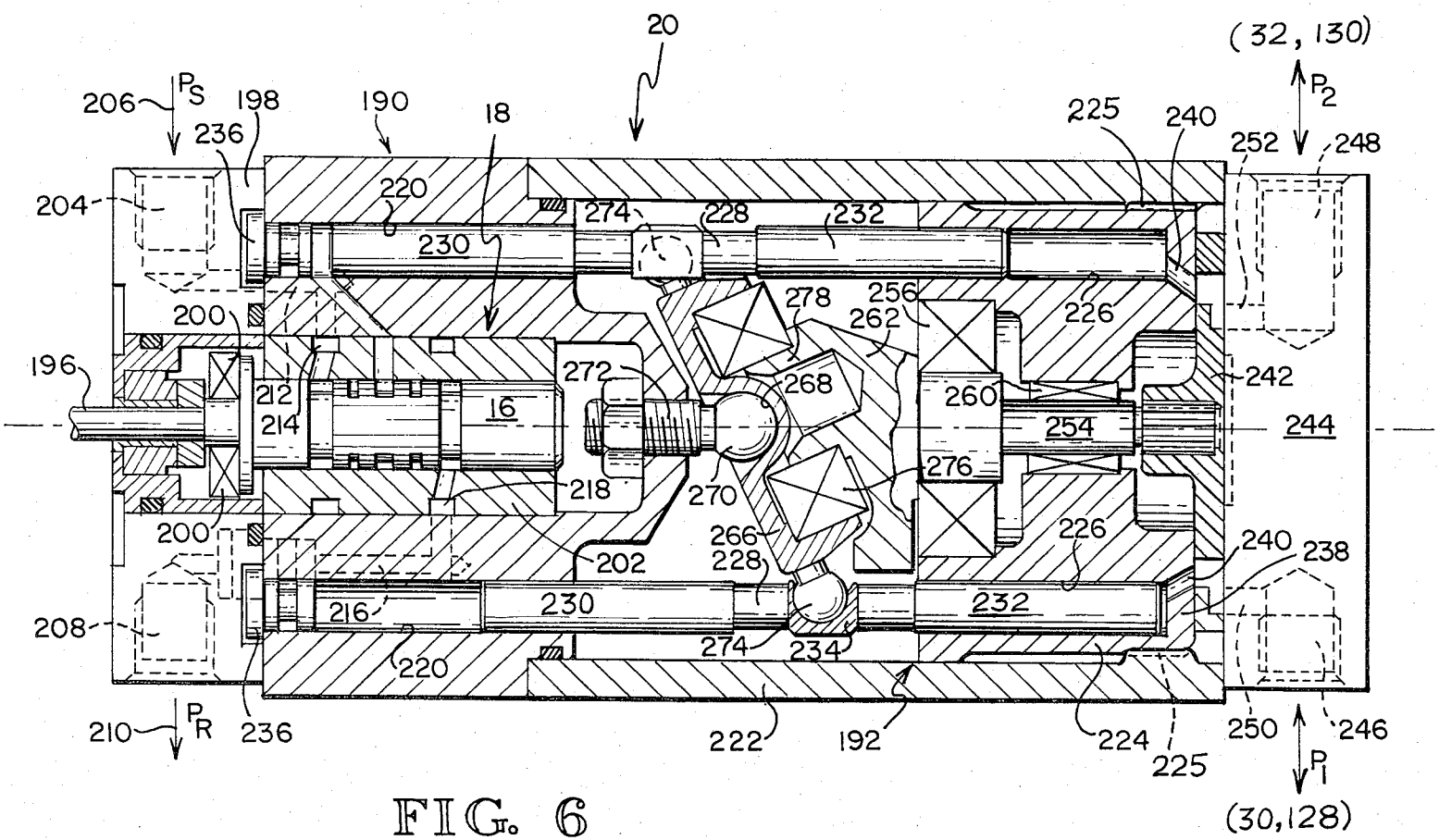
FIG. 6 is an axial sectional view of an embodiment of the hydraulic power transfer unit.

Referring now to FIG. 6, the distributor valve 18, the hydraulic motoring section 190 and the transfer or pumping section 192 of the power transfer unit 20 may share a common housing 194.

Unit 20 includes an input shaft 196 which is coupled to and is driven by the stepper motor shaft 14 (FIG. 1) and is journaled for rotation at one end of the housing 194 in a central portion of an end member 198, by means of a bearing 200. Shaft 196 is connected to and rotates the rotary port control member 16 of the distributor valve 18. Port control member 16 is rotatably received within a stationary valve sleeve 202.

End plate 198 is formed to include an inlet port 204 that is connected with the system pressure line 206 and a second port 208 which is connected with the system return line 210. Port 204 is a port of a passageway 212 which is shown to extend from the inner end of port 204, first axially through both end member 198 and an end portion of cylinder block 190, and then radially inwardly through cylinder block 190 to communicate with an annular groove 214 formed in the peripheral portion of sleeve 202. In similar fashion, another passageway extends from the inner end of port 208, first axially through both end member 198 and such end portion of cylinder block 190, then radially through cylinder block 190 to communicate with a second annular groove 218 formed in the periphery of sleeve 202, at a location spaced axially from groove 214. Ports and passageways formed in sleeve 202, port control member 16 and cylinder block 190 function to sequence pressurization as member 16 is rotated in accordance with a sequence plan such as shown in diagram I above.

The motoring cylinders 220 may constitute bores formed in the cylinder block 190.

By way of typical and therefore nonlimitive example, block 190 at its end opposite end member 198 of the motoring cylinder, may be telescopically received in, and connected to, an end of a tubular housing 222. A cylinder block 224 of the pumping or outlet section of the unit 20 may be housed within the opposite end portion of housing 222, and may be spline connected to the housing 222 at location 223 as illustrated. Cylinder block 224 is constructed to include the same number of cylinders 226 as motoring cylinder block 190. The motoring cylinders 220 and the pumping cylinders 226 are axially aligned and a double ended piston member 228 is associated with each aligned pair of cylinders 220, 226. The motoring pistons 230 and the pumping pistons 232 are separated by a spherical wobble plate coupling 234.

The ends of motoring cylinders 220 adjacent the end member 198 may be closed by plugs 236. The closed ends of pumping cylinders 226 are closed by a ported end wall portion 238 of the cylinder block 224 and a rotating disc valve member 242. A port 240 extends from each cylinder 226 through the end wall 238. The outer ends of ports 240 are open and closed by the rotating disc valve member 242 which is housed within unit 20, axially between end wall 238 of cylinder block 242 and an end member 244. End member 244 includes a first port 246 which connects to a line leading to ram chamber 30, 128 and a second port 248 which is connected to a line which leads to ram chamber 32, 130. Port 246 includes an axial portion 240 having an inner end which is adjacent to the rotating disc valve 242. In similar fashion, port 248 includes an axial portion 252 having an end which is also adjacent to the rotating disc valve 242. Disc valve 242 includes passageways in it which are separated by closed sections. The spacing and arrangement of the passageways in the disc valve 242 is such that each pumping cylinder 226 is in communication with one of the ports 246, 248 while the piston 232 therein is retracting and is in communication with one of the ports 246, 248 while the piston 232 therein is advancing.

Disc valve 242 is spline connected or otherwise attached to an end of the crank shaft 254 which may be journaled for rotation with cylinder block 224 by means of bearings 256, 260. A crank element 262 at the opposite end of shaft 254 engages a bearing 276 secured to a central portion of a wobble plate 266. The central portion of wobble plate 266, on the side thereof opposite bearing 276, is formed to provide a spherical socket or cup 268 having a flared entrance.

The socket 268 provides a seat for the spherical head 270 of a wobble plate preload pin 272.

At its periphery, wobble plate 266 carries a plurality of ball end couplers 274 which are equal in number and circumferentially spacing to the bearing cups 232. The couplings provided by the balls 274 and the cups 234 serve to tie the operation of the motoring piston-cylinder units 230, 220 together, so that increments of axial movement of the pistons 230 will be converted into increments of wobble movement of the wobble plate 226. Since the pumping and motoring pistons are connected, each such increment of axial movement of the motoring pistons 230 directly results in an equal amount of axial movement of the particular pumping piston 232 to which it is connected. As wobble plate 266 orbits about the center line of the unit 20, it applies a rotating torque to the crank 262. The wobble plate 266 wobbles in increments and the crank shaft 254 rotates in increments.

As illustrated, wobble plate 266 carries a bearing 276 which journels an end portion 278 of the crank 262 for rotation.

The subject invention is similar to, but yet is significantly different than, the invention of our co-pending application Ser. No. 117,388, filed Feb. 1, 1980, and entitled Rotary Digital Electrohydraulic Actuator. In the present invention, the hydraulic motoring section is used to power a pumping section, rather than to generate a rotary output for supplying torque to a shaft mounted element. In other words, in systems of the present invention the hydraulic motoring section is used to provide hydraulic flow and power reduction rather than a rotary output. Systems of the present invention may use a hydraulic ram output rather than a power hinge output, to provide a more efficient conversion of hydraulic input power to mechanical output.

It is estimated that a hydraulic ram actuator system embodying the present invention will provide a considerable reduction in hydraulic peak power demand and hydraulic system weight when compared with alternative actuator systems.

The hydraulic power transfer unit 20 may be a modified version of a hydraulic power transfer unit that is manufactured by Aero Hydraulics, Inc. of Ft. Lauderdale, Florida, a subsidiary of The Garrett Corporation. The modification of the Aero Hydraulics unit that is necessary in order to adapt it for use in practicing the present invention involves the removal of an internally commutated input plate valve from the hydraulic motoring section and the substitution therefore of an electric stepper motor driven valve of the type described herein.

The terms "motoring means" (or "motoring section") and "pumping means" (or "pumping section") are used herein to denote the two sections of the power transfer unit. These terms are used because the power transfer device is a unitary mechanism and not a motor driving a pump. However, in other installations it may be desirable to employ a hydraulic motor driving a pump in place of the power transfer unit. For that reason it is intended that the terms "motoring means", "motoring section", "pumping means", and "pumping section" be considered broad enough to also mean a true motor and a true pump in any combination of the two which performs the basic function of the power transfer unit in an installation which is covered by a claim herein.

What is claimed is:

1. Apparatus for effecting incremental drive of a hydraulic ram which includes a balanced piston, a first expansible chamber on one side of the balanced piston and a second expansible chamber on the opposite side of the balanced piston, said apparatus, comprising:

a reversible positive displacement means operable in one direction to transfer hydraulic fluid from a first expansible chamber to a second expansible chamber, and operable in the opposite direction to transfer hydraulic fluid from a second chamber to a first chamber; and means for effecting incremental operation of said positive displacement means, comprising:

hydraulic motoring means drivingly connected to said positive displacement means, said hydraulic motoring means comprising a plurality of cylinders, pistons within said cylinders, and means operable in response to sequenced pressurization of the cylinders, and attendant piston movement, to apply a driving force to said reversible positive displacement means;

distributor valve means including a rotary control member and port means controlled by rotation of said rotary control member for communicating hydraulic pressure to a group of said cylinders which are in series while venting the rest of said cylinders to a return line;

means for generating electrical digital command pulse signals; and an electric stepping motor operable by said electrical digital command pulse signals to rotate in increments, and including a rotary output connected to the rotary control member of the distributor valve means, with rotation of said rotary control member sequencing pressurization by progressively adding a cylinder to the forward edge of the pressurized group of cylinders and removing a cylinder from the trailing edge of the pressurized group of cylinders, to in that manner deliver driving pulses of hydraulic pressure to the hydraulic motoring means, with the pistons of each new group of pressurized cylinders functioning to drive the positive displacement means into a new position of equilibrium and then hold it in such position until there is another change in the make-up of the pressurized group of cylinders, whereby an increment of movement of the positive displacement means occurs in direct response to each command pulse that is received by the stepping motor, attended by an increment of fluid transfer and a corresponding increment of linear movement of the hydraulic ram.

2. Apparatus aboard an aircraft for positioning a component of the aircraft, capable of accepting a digital command, comprising:

a balance piston linear hydraulic ram comprising a cylinder, a balanced piston within said cylinder dividing the cylinder into first and second expansible chambers on opposite sides of the piston; and means for incrementally driving said ram comprising:

a reversible positive displacement pumping means operable in one direction to transfer hydraulic fluid from the first expansible chamber of said ram to the second expansible chamber of said ram, and operable in the opposite direction to transfer hydraulic fluid from the second chamber to the first chamber; and means for incrementally driving said rotary positive displacement pumping means, comprising;

hydraulic motoring means drivenly connected to said positive displacement pumping means, said hydraulic motoring means comprising a plurality of cylinders, pistons within said cylinders, and means operable in response to sequenced pressurization of the cylinders, said attendant piston movement, to apply driving forces to pumping means;

distributor valve means including a rotary control member and port means controlled by rotation of said rotary control member for communicating hydraulic pressure to a group of said cylinders which are a series while venting the rest of said cylinders to a return line;

means for generating electrical digital command pulse signals; and;

an electric stepping motor operable by said digital command pulse signals to rotate in increments, and including a rotary output connected to the rotary control member of the distributor valve means, with rotation of said rotary control member sequencing pressurization by progressively adding a cylinder to the forward edge of the pressurized group of cylinders and removing a cylinder from the trailing edge of the pressurized group of cylinders, to in that manner deliver driving pulses of hydraulic pressure to the hydraulic motoring means, with the pistons of each new group of pressurized cylinders functioning to drive the pumping means into a new position of equilibrium and then hold it in such position until there is another change in the makeup of the pressurized group of cylinders, whereby an increment of displacement occurs in direct response to each command pulse that is received by the stepping motor, attended by an increment of fluid transfer by the displacement means, and a corresponding increment of linear movement of the ram and an aircraft component positioned by it.

3. Apparatus according to claim 2, further comprising means for maintaining a predetermined desired average pressure level between the two sides of the ram piston, to maintain output stiffness of the ram.

4. Apparatus according to claim 3, wherein said average pressure maintance means comprises a regulating valve, and means operable in response to a fluid signal representing an average of the pressures on the opposite sides of the ram piston to meter flow from a supply pressure line to one of the expansible chambers and from the other expansible chamber to a return pressure line, to maintain the average pressure at a predetermined desired value.

5. Apparatus according to claim 4, wherein the regulating valve means comprises a slide member and port means controlled by axial movement of said slide member, a biasing spring acting on one end of the slide member, and two separate pressure surfaces at the opposite end of the slide member, wherein in use one of said surfaces is in communication with one of the expansible chambers and the other surface is in communication with the other expansible.

6. Apparatus according to claim 3 wherein said average pressure maintaining means comprises a four-way linear valve including a housing means defining metering ports, a port control member in said housing, and means responsive to the position of the rotary output of the stepping motor for positioning the port control member relative to said ports.

7. An electrohydraulic mechanism, comprising:

an electric stepping motor operable by digital command signals to rotate in increments, and including a rotary output;

pumping means comprising a plurality of cylinders, and pistons within said cylinders movable axially;

hydraulic motoring means including a plurality of cylinders, pistons within said cylinders, and means operable in response to sequenced pressurization of the cylinders, and attendant piston movement, to apply driving forces to the pistons of said pumping means;

distributor valve means including a rotary control member and port means controlled by rotation of said rotary control member for communicating hydraulic pressure to a group of said motoring means cylinders which are in series while venting the rest of said cylinders;

means connecting the rotary output of the electric stepping motor to the rotary control member of the distributor valve means; and valve means for said pumping cylinders, communicating each pumping cylinder with a hydraulic fluid inlet port during retraction of the pistons and with an outlet port during extension of the pistons.

8. A mechanism according to claim 7, wherein said hydraulic motoring means comprises a cylinder block in which the motoring cylinders are formed, and wherein the distributor valve means is centrally located within said cylinder block.

9. Mechanism according to claim 7, wherein there is an equal number of pumping and motoring cylinders, the pumping and motoring cylinders extend axially of the mechanism and are arranged in a ring about the center line of the mechanism, and the pumping and motoring cylinders are coaxial, and wherein each motoring piston is joined with a pumping piston.

10. A mechanism according to claim 9, comprising a wobble plate connected at its periphery to said pistons, for coordinating movement of the pistons.

11. A mechanism according to claim 10 wherein said valve means comprises a rotating ported disc, a crank shaft for rotating said ported disc, and means connected to the wobble plate for driving the crank shaft.

12. Apparatus for effecting incremental drive of a balanced piston hydraulic ram, comprising:

a balanced piston hydraulic ram having a first expansible chamber on one side of the balanced piston and a second expansible chamber on the opposite side of the piston;

a reversible positive displacement means operable in one direction to transfer hydraulic fluid from the first expansible chamber to the second expansible chamber, and operable in the opposite direction to transfer hydraulic fluid from the second chamber to the first chamber; and means for effecting incremental operation of said positive displacement means, comprising:

hydraulic motoring means drivingly connected to said positive displacement means, said hydraulic motoring means comprising a plurality of cylinders, pistons within said cylinders, and means operable in response to sequenced pressurization of the cylinders, and attendant piston movement, to apply a driving force to said reversible positive displacement means;

distributor valve means including a rotary control member and port means controlled by rotation of said rotary control member for communicating hydraulic pressure to a group of said cylinders which are in series while venting the rest of said cylinders to a return line;

means for generating electrical digital command pulse signals; and an electric stepping motor operable by said electrical digital command pulse signals to rotate in increments, and including a rotary output connected to the rotary control member of the distributor valve means, with rotation of said rotary control member sequencing pressurization by progressively adding a cylinder to the forward edge of the pressurized group of cylinders and removing a cylinder from the trailing edge of the pressurized group of cylinders, to in that manner deliver driving pulses of hydraulic pressure to the hydraulic motoring means, with the pistons of each new group of pressurized cylinders functioning to drive the positive displacement means into a new position of equilibrium and then hold it in such position until there is another change in the make-up of the pressurized group of cylinders, whereby an increment of movement of the positive displacement means occurs in direct response to each command pulse that is received by the stepping motor, attended by an increment of fluid transfer between the expansible chambers of the ram and a corresponding increment of linear movement of the hydraulic ram.

13. Apparatus according to claim 12, further comprising means for maintaining a predetermined desired average pressure level between the two sides of the ram piston, to maintain output stiffness of the ram.

14. Apparatus according to claim 13, wherein said average pressure maintenance means comprises a regulating valve, and means operable in response to a fluid signal representing an average of the pressures on the opposite sides of the ram piston to meter flow from a supply pressure line to one of the expansible chambers and from the other expansible chamber to a return pressure line, to maintain the average pressure at a predetermined desired value.

15. Apparatus according to claim 14, wherein the regulating valve means comprises a slide member, a biasing spring acting on one end of the slide member, and two separate pressure surfaces at the opposite end of the slide member, wherein in use one of said surfaces is in communication with one of the expansible chambers and the other surface is in communication with the other expansible chamber.

16. Apparatus according to claim 13, wherein said average pressure maintaining means comprises a four-way linear valve including a housing means defining metering ports and a port control member in said housing, and means responding to the position of the rotary output of the stepping motor for controlling the position of the port control member relative to said ports.

17. Apparatus according to claim 16, wherein said means responding comprises a crank arm connected to the rotary output of the rotary stepping motor and linkage means interconnected between the crank arm and said and said port control member.

* * * * *

UNITED STATES PATENT AND TRADEMARK OFFICE

CERTIFICATE OF CORRECTION

PATENT NO. : 4,363,211

DATED : December 14, 1982

INVENTOR(S) : Curtiss W. Robinson and Eugene T. Raymond

It is certified that error appears in the above-identified patent and that said Letters Patent are hereby corrected as shown below:

Column 5, line 26, "chamers" should be --chambers--.

Column 8, line 3, the number following "Shaft" should be --196--.

Claim 1, column 10, line 60, --signal-- should follow "pulse".

Claim 1, column 10, line 62, --by the displacement means-- should follow "transfer".

Claim 2, column 11, line 11, "rotary" should be deleted.

Claim 2, column 11, line 18, "said" should be --and--.

Claim 2, column 11, line 19, --said-- should follow "to".

Claim 2, column 11, line 24, "a" should be --in--.

Claim 2, column 11, line 45, --signal-- should follow "pulse".

Claim 2, column 11, line 47, --pumping-- should follow "displacement".

Claim 5, column 11, line 65, "means" should be deleted.

Claim 5, column 12, line 4, --chamber-- should follow "expansible".

Claim 9, column 12, line 43, "Mechanism" should be --A mechanism--.

UNITED STATES PATENT AND TRADEMARK OFFICE

CERTIFICATE OF CORRECTION

PATENT NO. : 4,363,211

DATED : December 14, 1982

INVENTOR(S) : Curtiss W. Robinson and Eugene T. Raymond

It is certified that error appears in the above-identified patent and that said Letters Patent are hereby corrected as shown below:

Claim 11, column 12, line 54, --for said pumping cylinders-- should follow "means".

Claim 12, column 13, line 39, --signal-- should follow "pulse".

Claim 15, column 14, line 19, "means" should be deleted.

Claim 17, column 14, line 35, "rotary", second occurrence, should be deleted.

Claim 17, column 14, line 37, "and said", first occurrence, should be deleted.

Signed and Sealed this

*Thirteenth* Day of *December 1983*

[SEAL]

*Attest:*

GERALD J. MOSSINGHOFF

*Attesting Officer*

*Commissioner of Patents and Trademarks*